US009067305B2

(12) United States Patent
Saridikmen et al.

(10) Patent No.: US 9,067,305 B2
(45) Date of Patent: Jun. 30, 2015

(54) POLYCRYSTALLINE DIAMOND

(75) Inventors: Habib Saridikmen, Edenvale (ZA); Iain Patrick Goudemond, Gauteng (ZA); Antionette Can, Gauteng (ZA); Roger William Nigel Nilen, Gauteng (ZA); Clement David van der Riet, Spring, TX (US)

(73) Assignees: ELEMENT SIX ABRASIVES S.A., Luxembourg (LU); ELEMENT SIX LIMITED (IE)

( * ) Notice: Subject to any disclaimer, the term of this patent is extended or adjusted under 35 U.S.C. 154(b) by 538 days.

(21) Appl. No.: 13/110,150

(22) Filed: May 18, 2011

(65) Prior Publication Data

US 2011/0283628 A1 Nov. 24, 2011

Related U.S. Application Data

(60) Provisional application No. 61/345,755, filed on May 18, 2010.

(51) Int. Cl.

| | |
|---|---|
| ***B24D 3/00*** | (2006.01) |
| ***B01J 3/06*** | (2006.01) |
| ***B24D 18/00*** | (2006.01) |
| ***B24D 99/00*** | (2010.01) |

(52) U.S. Cl.

CPC ..... *B24D 18/0009* (2013.01); *B24D 99/005* (2013.01)

(58) Field of Classification Search

CPC ..... B24D 3/00; B01J 3/06

USPC ..... 51/307, 293; 175/374, 426, 434

See application file for complete search history.

(56) References Cited

U.S. PATENT DOCUMENTS

| | | | | |
|---|---|---|---|---|
| 2005/0115744 | A1 | 6/2005 | Griffin et al. | |
| 2006/0266558 | A1 * | 11/2006 | Middlemiss et al. | 175/426 |
| 2008/0142276 | A1 | 6/2008 | Griffo et al. | |
| 2008/0185189 | A1 | 8/2008 | Griffo et al. | |
| 2008/0230280 | A1 | 9/2008 | Keshavan et al. | |
| 2009/0178855 | A1 | 7/2009 | Zhang et al. | |
| 2010/0012390 | A1 | 1/2010 | Shamburger | |

FOREIGN PATENT DOCUMENTS

| | | |
|---|---|---|
| GB | 1598837 | 9/1981 |

* cited by examiner

*Primary Examiner* — Pegah Parvini

(74) *Attorney, Agent, or Firm* — Bryan Cave LLP

(57) ABSTRACT

A method for making a polycrystalline diamond (PCD) construction comprises providing a cemented carbide substrate comprising carbide grains cemented together by a cement material, subjecting the substrate to a first pressure treatment, treating the substrate to remove at least some of the cement material from at least a region of the substrate adjacent a boundary defined by the substrate, and subjecting the substrate to a second pressure treatment, in contact with or bonded at the boundary to a diamondiferous structure.

8 Claims, 4 Drawing Sheets

POLYCRYSTALLINE DIAMOND

FIELD

This disclosure relates to polycrystalline diamond (PCD) constructions, particularly but not exclusively for boring into the earth, or degrading or drilling into hard or abrasive bodies such as rock or asphalt, and to a method for making same.

BACKGROUND

Cutter inserts for drill bits for use in boring into the earth may comprise a layer of polycrystalline diamond (PCD) bonded to a cemented carbide substrate. Polycrystalline diamond (PCD) is an example of a superhard material (also called superabrasive material) comprising a mass of substantially inter-grown diamond grains, forming a skeletal mass defining interstices between the diamond grains. PCD material may comprise at least about 80 volume % of diamond and may be made by subjecting an aggregated mass of diamond grains to an ultra-high pressure of greater than about 5 GPa and a temperature of at least about 1,200 degrees centigrade in the presence of a catalyst material for diamond, which is material that is capable of promoting direct inter-growth of diamond grains at a pressure and temperature at which diamond is thermodynamically more stable than graphite. Some catalyst materials for diamond may promote the conversion of diamond to graphite at ambient pressure, particularly at elevated temperatures. Examples of such catalyst materials are cobalt, iron, nickel and certain alloys including any of these. PCD may be formed on a cobalt-cemented tungsten carbide substrate, which may provide a source of cobalt catalyst material for the PCD. The interstices with PCD may be at least partly be filled with catalyst material for diamond.

PCD is extremely hard and abrasion resistant, which is the reason it is the preferred tool material in some of the most extreme machining and drilling conditions, and where high productivity is required. A disadvantage of PCD containing certain catalyst materials for diamond as a filler material may be its relatively poor thermal stability above about 400 degrees centigrade. The catalyst material may promote the degradation of the PCD at elevated temperature, particularly at temperatures greater than about 750 degrees centigrade, as may be experienced in manufacture and use of PCD compacts.

GB patent number 1 598 837 discloses removing metallic phase infiltrant material from a PCD compact comprising a PCD layer bonded to the cobalt cemented tungsten carbide layer by boiling in acid. Prior to immersion in the acid, epoxy resin was cast around the compact, leaving the surface of the diamond layer exposed by sanding away all of the plastic on the surface of the layer.

United States patent application publication number 20050115744 discloses a method of manufacture of a PCD element comprising a body integrally formed with a metallic substrate, the body comprising bonded diamond crystals and a catalysing material is also disclosed. The treatment is performed by treating the body to render a volume thereof substantially free of the catalysing material while permitting the catalysing material to remain in at least some of the remaining volume of the body and while permitting the substrate to remain substantially unaffected when treating the body.

United States patent application publication number 20080142276 discloses a method for making a thermally stable ultra-hard material compact construction comprising a body and a substrate. The method comprises the steps of: forming a thermally stable polycrystalline diamond body by removing a catalyst material therefrom; aligning complementary surface features positioned along interfacing surfaces of the body and substrate with one another so that they engage one another; and joining the body to the substrate.

United States patent application publication number 20090178855 discloses making thermally stable PCD (TSP). Firstly, a polycrystalline diamond layer is formed over a substrate at a non-uniform interface using known sintering methods. After sintering the PCD layer on the substrate, the substrate is removed so as to expose the non-uniform interface. The PCD layer is then leached as necessary to form the appropriate TSP layer.

United States patent application publication number 20080185189 discloses attaching a leached PCD compact to a substrate in a second HPHT (high pressure, high temperature) sintering step.

United States patent application publication number 2008230280 discloses a method for making PCD constructions by treating a polycrystalline diamond body to remove solvent catalyst material disposed within interstitial regions between the bonded together diamond crystals, and then replacing the solvent catalyst material with a replacement material.

United States patent application publication number 20100012390 discusses that where thermally stable PDC elements are produced by leaching out the cobalt or other binder-catalysing material, the leaching process also removes the cemented carbide substrate. In addition, because there is no integral substrate or other bondable surface, there are severe difficulties in mounting such material for use in operation. Subsequent joining of the leached PCD element to a tungsten carbide substrate in a high-pressure, high-temperature environment results in an abrupt transition between the diamond layer and the substrate, making the diamond layer susceptible to wholesale fracture at the interface at very low strains.

SUMMARY

Viewed from a first aspect there is provided a method for making a polycrystalline diamond (PCD) construction, the method comprising providing a cemented carbide substrate comprising carbide grains cemented together by a cement material; subjecting the cemented carbide substrate to a first pressure treatment; treating the substrate to remove at least some of the cement material from at least a region of the substrate; and subjecting the substrate to a further pressure treatment in contact with or bonded to a diamondiferous structure.

Some embodiments provide a method for making a polycrystalline diamond (PCD) construction, the method comprising providing a cemented carbide substrate comprising carbide grains cemented together by a cement material; subjecting the cemented carbide substrate to a first pressure treatment; treating the substrate to remove at least some of the cement material from at least a region of the substrate adjacent a boundary defined by the substrate; and subjecting the substrate to a further pressure treatment in contact with or bonded to a diamondiferous structure at the boundary.

In one embodiment, the method may include subjecting the cemented carbide substrate to one or more pressure treatments at an ultra-high pressure, high temperature (HPHT), in which the pressure is at least about 1 GPa or at least about 5.5 GPa. In some embodiments, the method may include subjecting the cemented carbide substrate to a first pressure treatment at an ultra-high pressure, high temperature (HPHT), in which the temperature is at least about 1,000 degrees centigrade or at least about 1,250 degrees centigrade. In one embodiment, the method may include subjecting the substrate to a first pressure treatment for a period of at least about 30 seconds.

In one embodiment, the boundary defined by the substrate may be substantially non-planar.

In one embodiment, the diamondiferous structure may comprise an aggregate mass of diamond grains, and in one embodiment the aggregated mass may comprise diamond grains bonded together by means of a binder, such as an organic binder.

In one embodiment, the method may include joining the diamondiferous structure to the substrate during the first pressure treatment. In one embodiment, the diamondiferous structure may comprise PCD material, and in one embodiment the PCD is thermally stable PCD (TSP). In one embodiment, the diamondiferous body may comprise chemical vapour deposited (CVD) diamond.

In one embodiment, the method may include forming a PCD structure during the first pressure treatment. In one embodiment, the method may include integrally forming a PCD structure with the substrate during the first pressure treatment to form a precursor PCD construction; treating the precursor PCD construction to remove at least some of the cement material from at least a region of the substrate adjacent a boundary defined by the substrate; and subjecting the precursor PCD construction to a further pressure treatment. In one embodiment, the method may include providing a precursor PCD construction by a method including subjecting a cemented carbide substrate for a PCD compact to an ultra-high pressure and an ultra-high temperature at which diamond is thermodynamically more stable than graphite, in contact with an aggregate mass of diamond grains in the presence of a catalyst material for diamond.

In one embodiment, the method may include joining the precursor PCD construction to a support body, for example to a cemented carbide support body. In one embodiment, the method may include interposing a layer between the precursor PCD construction and the support body.

In one embodiment, the method may include interposing a layer between the diamondiferous structure and the substrate. In some embodiments, the layer may be in the form of a foil, shim or powder, and in some embodiments, the layer may comprise an alloy of Pd and Ni; an alloy of Ti, Cu and Ni; an alloy of Pd and Co; an alloy of Pd, Ni and Si; Zr or an austenitic nickel-chromium-based superalloy.

In one embodiment, the method may include placing a source of infiltrant material against the diamondiferous structure, the diamondiferous structure being at least partly porous, and subjecting the substrate to a further pressure treatment at a pressure and temperature at which the infiltrant material is molten and is capable of infiltrating into pores within the diamondiferous structure, in contact with or bonded to the diamondiferous structure. In some embodiments, the infiltrant material may comprise Si or Al, or both Si and Al.

In one embodiment, the method may include subjecting the cemented carbide substrate to a first pressure treatment; treating the substrate to remove at least some of the cement material from at least a region of the substrate adjacent a boundary defined by the substrate; contacting a PCD structure with the substrate at the boundary to form a precursor assembly, and subjecting the precursor assembly to the further pressure treatment.

In one embodiment, the method may include treating the diamondiferous structure to remove metal catalyst for diamond from at least a region therein. In one embodiment, the method may include treating the PCD construction to remove cement material from the substrate.

In one embodiment, the further pressure treatment may include subjecting the substrate and the diamondiferous structure to an ultra-high pressure and high temperature (HPHT), at which diamond is thermodynamically more stable than graphite. In one embodiment, the further pressure treatment may include subjecting the substrate and the diamondiferous structure to a pressure of at least about 5.5 GPa and a temperature of at least about 1,200 degrees centigrade, at least about 1,300 degrees centigrade or at least a temperature at which the cement material of the substrate is capable of being molten at the ultra-high pressure. In some embodiments, the further pressure treatment may be carried out at a pressure of at least about 6 GPa, at least about 7 GPa or at least about 8 GPa. In one embodiment, the further pressure treatment may be carried out at a pressure at which diamond is thermodynamically less stable than graphite, and in one embodiment, the further pressure treatment may be carried out at less than about 2 GPa, for example by means of hot isostatic pressing.

In one embodiment, the cemented carbide substrate may comprise cemented tungsten carbide, in which the cement material comprises a catalyst material for diamond. In one embodiment, the cement material may comprise cobalt.

An embodiment provides a PCD construction made using the method(s).

BRIEF DESCRIPTION OF THE DRAWINGS

Non-limiting embodiments will now be described by way of example and with reference to the accompanying drawings in which.

The same references are used to refer to the same features in all drawings.

DETAILED DESCRIPTION OF EMBODIMENTS

As used herein, polycrystalline diamond (PCD) is a material that comprises at least 80 volume percent of diamond grains, a substantial portion of which are directly interbonded with each other, forming a skeletal mass.

As used herein, a diamondiferous structure is a structure comprising diamond.

Figure 1:
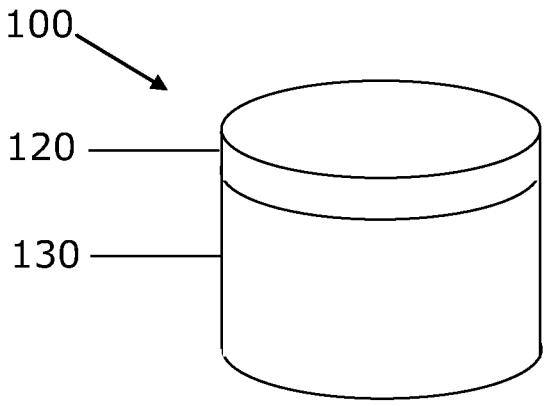
FIG. 1 shows a schematic perspective view of an embodiment of a PCD construction.
Figure 2A:
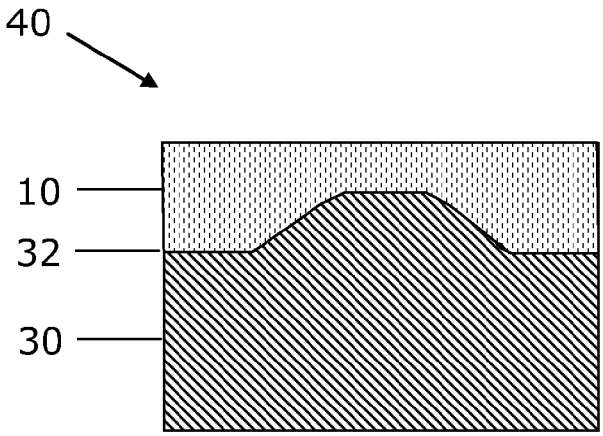
FIG. 2A, FIG. 2B, FIG. 2C and FIG. 2D show schematic views of cross sections of various structures involved in using an embodiment of a method to make a PCD construction.
Figure 2B:
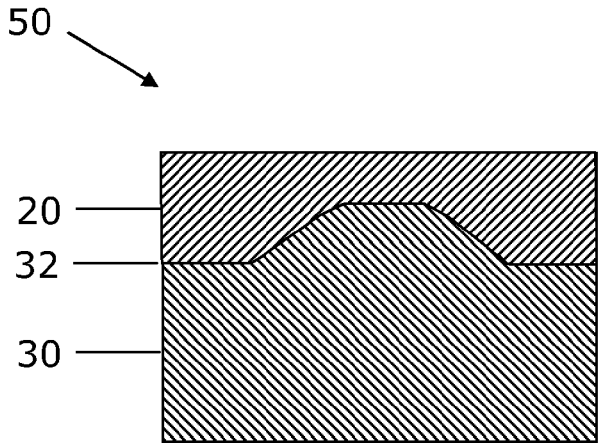
Figure 2C:
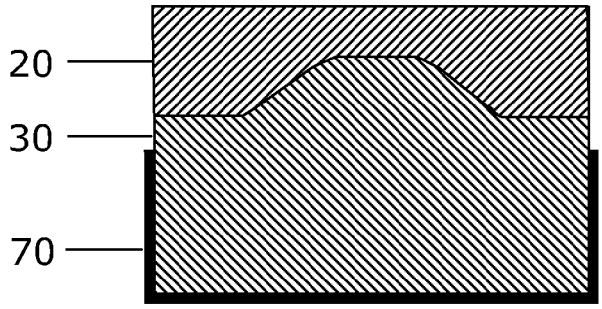
Figure 2D:
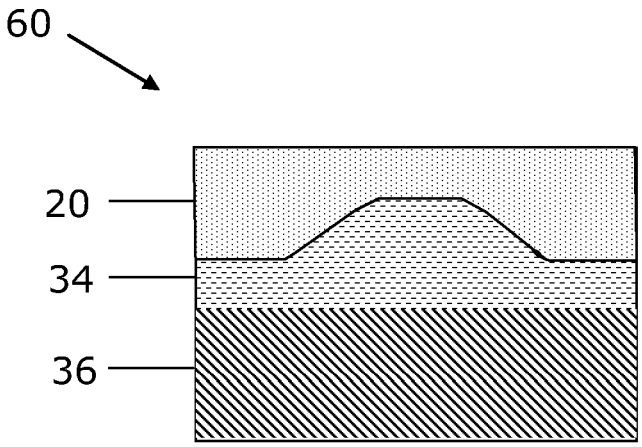

With reference to FIG. 1, an embodiment of a PCD construction 100 for boring into the earth comprises a PCD structure 120 bonded to a cemented carbide substrate 130 comprising grains of carbide material bonded together by means of a cement material (microstructure not shown).

With reference to FIG. 2A, FIG. 2B, FIG. 2C and FIG. 2D, an embodiment of the method includes placing an aggregate mass 10 of diamond grains onto a surface 32 of a cobalt cemented tungsten carbide substrate 30 to form a pre-sinter assembly 40 and subjecting the pre-sinter assembly 40 to a first HPHT treatment at an ultra-high pressure of about 5.5 GPa and a high temperature of about 1,350 degrees centigrade, to form a precursor PCD construction 50 comprising a PCD structure 20 integrally formed with the substrate 30 at a boundary defined by the surface 32 of the substrate. During the HPHT treatment, molten Co from the substrate 30 infiltrates into the aggregate mass 10 of diamond grains. The PCD structure 20 comprises an inter-bonded skeletal mass of diamond grains defining interstitial regions among the diamond grains, and the interstitial regions are substantially filled with binder material comprising the cobalt. The precursor PCD construction 50 is then immersed in heated acid for about one day to remove substantially all of the cobalt from the PCD structure 20 and from a region 34 of the substrate 30 adjacent the interface 32 with the PCD structure, to form a catalyst depleted precursor PCD construction 60. Removal of cobalt from region 36 of the substrate 30 may be prevented by protecting the surface of the substrate 30 by means of an acid resistant mask 70. Surprisingly, the substrate 30 has sufficient strength after the HPHT treatment and subsequent treatment in acid for the catalyst depleted precursor PCD construction 60 to be handled. The catalyst depleted precursor PCD construction 60 is then subjected to a second HPHT treatment, at an ultra-high pressure of about 5.5 GPa and a temperature of about 1,350 degrees centigrade to form an embodiment of a PCD construction. Cobalt from region 36 of the substrate 30 infiltrates into region 34 of the substrate 30 and into the interstices of the PCD structure 20 during the second HPHT treatment.

Figure 3A:
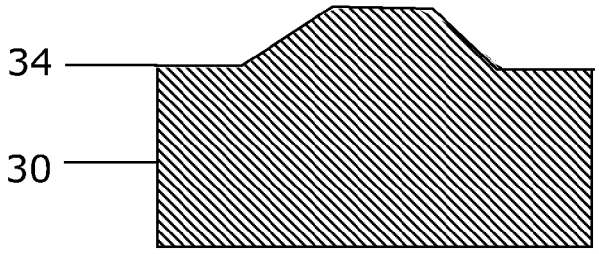
FIG. 3A and FIG. 3B show schematic views of cross sections of various structures involved in using an embodiment of a method to make a PCD construction.
Figure 3B:
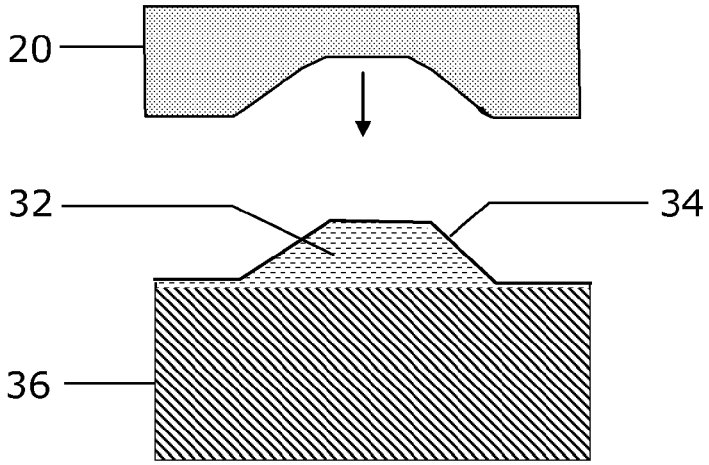

With reference to FIG. 3A and FIG. 3B, an embodiment of a method includes providing a cobalt-cemented tungsten carbide substrate 30 and a PCD precursor structure 20 from which catalyst material for diamond has been removed. The substrate 30 comprises an end 38 configured to the desired shape of the boundary 34 between a precursor PCD structure 20 and the substrate 30, and the PCD precursor structure 20 comprises an end having a complementary shape. The PCD precursor structure may be made by sintering a PCD layer on a substrate in a first HPHT treatment, removing the substrate by, for example, grinding, and immersing the PCD precursor body into heated acid for a sufficient period for substantially all catalyst material to be removed from the interstices of the PCD precursor body to form a thermally stable PCD precursor structure. The substrate 30 is treated in acid to remove cobalt binder from a region 32 adjacent the boundary surface 34, and the PCD precursor structure 20 is placed onto the boundary surface 34 to form a pre-sinter assembly. The pre-sinter assembly is then subjected to a second HPHT treatment, at an ultra-high pressure of about 5.5 GPa and a temperature of about 1,350 degrees centigrade to form an embodiment of a PCD construction. Cobalt from region 36 of the substrate 30 infiltrates into region 34 of the substrate 30 and into the interstices of the PCD structure 20 during the second HPHT treatment.

Figure 4:
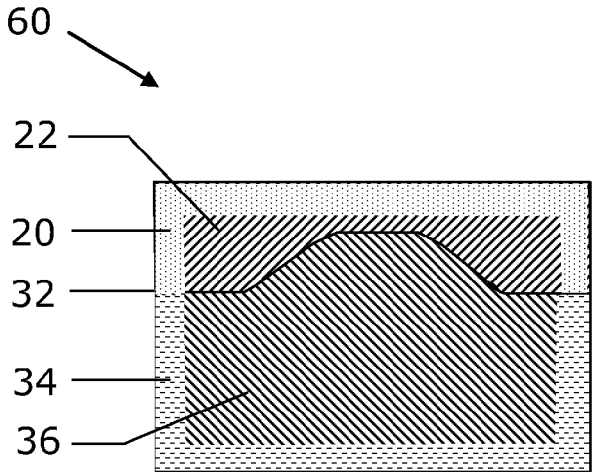
FIG. 4 shows a schematic cross section view of an embodiment of a precursor PCD structure.

With reference to FIG. 4, an embodiment of the method includes providing a precursor PCD construction comprising a PCD structure bonded to a cobalt cemented tungsten carbide substrate, and treating the pre-cursor PCD construction to remove at least some of the cobalt at least a surface region 34 of the substrate adjacent the surface, and to remove substantially all of the catalyst material for diamond from a surface region 20 of the PCD structure. Catalyst material for diamond is not removed from an interior region 22 remote from the surface of the PCD structure, and binder material is not removed from an interior region 36 of the substrate. The cobalt is selectively removed from the region 34 of the substrate and the region 22 of the PCD structure by immersing the precursor PCD construction in heated acid for a period of several hours to several days, depending on the desired depths of respective surface regions 22 and 34. The treated precursor PCD construction 60 is then subjected to an ultra-high pressure of at least about 5.5 GPa and an ultra-high temperature of at least about 1,250 degrees centigrade.

Examples of methods that may be used to remove catalyst material from PCD structures or binder material from cemented carbide, or both, include immersion in acid, zinc process, cold stream process, alkaline leach process, a chlorination approach, electrolysis and high temperature smelting.

EXAMPLES

An embodiment is described in more detail with reference to the examples below, which are not intended to be limiting.

Example 1

A PCD cutter insert for an earth boring bit may be provided for use as a precursor PCD construction, comprising a PCD cutting structure bonded to an end of a cobalt cemented tungsten carbide substrate. The PCD insert may have been manufactured by sintering diamond grains together on the substrate at an ultra-high pressure of about 5.5 GPa and a temperature of about 1,350 degrees centigrade, as is well known in the art. The insert may have a generally cylindrical shape with a diameter of about 16 mm and overall length of about 1.5 cm. The interface between the PCD structure and the substrate may be non-planar, the substrate having a central portion projecting into a complementary recess within the PCD structure. The thickness of the PCD structure may be about 2.2 mm apart from the recess, which may be about 1 mm deep. The configuration of the non-planar interface may be of a design which may enhance the fracture resistance of the insert in use. The diamond content of the PCD structure may be about 89 volume %, the diamond grains having a mean size of about 5 microns in terms of equivalent circle diameter.

The PCD cutter insert may be subjected to acid treatment to remove cobalt from substantially the whole volume of the PCD cutting structure and a region of the substrate adjacent the boundary with the PCD structure. A mask comprising acid resistant epoxy resin may be applied to the surface of the portion of the substrate from which cobalt binder removal is to be avoided. The PCD cutter insert thus treated may then be used as a precursor PCD construction, carefully assembled into a capsule for an ultra-high pressure furnace and subjected to a pressure of about 6.6 GPa and a temperature of about 1,500 degrees centigrade for about 10 minutes. The PCD construction thus formed would comprise a PCD structure with enhanced diamond grain contiguity, still bonded to the substrate, and cobalt binder would have infiltrated from the region of the substrate from which binder had not been removed into the region from which it had been removed, as well as into at least a region of the PCD structure adjacent the boundary with the substrate.

Example 2

A PCD insert was manufactured by sintering diamond grains together on the substrate at an ultra-high pressure of about 5.5 GPa and a temperature of about 1,350 degrees centigrade, as is well known in the art. The insert had a generally cylindrical shape with a diameter of about 17.3 mm and the thickness of the PCD layer was around 2 mm with the overall length of the insert being around 12.5 mm. The interface between the PCD structure and the substrate was non-planar, the substrate having a central portion projecting into a complementary recess within the PCD structure. The diamond content of the PCD structure may be about 89 volume %, the diamond grains having a mean size of about 9 microns in terms of equivalent circle diameter.

The PCD cutter insert was placed in a Teflon® fixture and was subjected to acid treatment using hydrochloric acid to remove cobalt from substantially the whole volume of the PCD cutting structure and a region of the substrate adjacent the boundary with the PCD structure. A mask comprising acid resistant epoxy resin was applied to the surface of the portion of the substrate from which cobalt binder removal is to be avoided. The leaching of the substrate was particularly pronounced around the edges of the cutter insert. The PCD cutter insert, thus treated, was then be used as a precursor PCD construction, carefully assembled into a capsule for an ultra-high pressure furnace and subjected to a pressure of about 5.5 GPa and a temperature of about 1,400 degrees centigrade for between about 5 to 10 minutes and the subjected to a pressure of about 6.8 GPa and a temperature of about 1450 degrees centigrade for between about 5 to 10 minutes. The PCD construction thus formed comprised a PCD structure with enhanced diamond grain contiguity, still bonded to the substrate, and cobalt binder infiltrated from the region of the substrate from which binder had not been removed into the region from which it had been removed, as well as into at least a region of the PCD structure adjacent the boundary with the substrate.

Image analysis was conducted on the re-sintered cutter and compared with the image analysis results on an unleached PCD cutter which had not been subjected to re-sintering. The average grain size of the PCD in both cutters was 9 microns. The unleached PCD cutter had an average diamond contiguity of 64% and the leached and re-sintered PCD had a diamond contiguity of 69%. This increase in contiguity may give rise to increased wear resistance performance of the leached and re-sintered cutter compared with equivalent sintered materials (unleached) in vertical borer rock drilling applications testing.

Example 3

A PCD insert was manufactured by sintering diamond grains together on the substrate at an ultra-high pressure of about 5.5 GPa and a temperature of about 1,350 degrees centigrade, as is well known in the art. The insert had a generally cylindrical shape with a diameter of about 17.3 mm and the thickness of the PCD layer was around 2 mm with the overall length of the insert being around 12.5 mm. The interface between the PCD structure and the substrate was non-planar, the substrate having a central portion projecting into a complementary recess within the PCD structure. The diamond content of the PCD structure may be about 89 volume %, the diamond grains having a mean size of about 9 microns in terms of equivalent circle diameter.

The PCD cutter insert was placed in a Teflon® fixture and was subjected to acid treatment using hydrochloric acid to remove cobalt from substantially the whole volume of the PCD cutting structure and a region of the substrate adjacent the boundary with the PCD structure. A mask comprising acid resistant epoxy resin was applied to the surface of the portion of the substrate from which cobalt binder removal is to be avoided. The leaching of the substrate was particularly pronounced around the edges of the cutter insert. The leaching rate was found to be faster along the barrel of the cutter insert compared with the top of the PCD. The PCD was leached down to a depth of about 700 microns, with accelerated leaching on the barrel of the PCD resulting in partial leaching of the substrate along the outer diameter of the cutter insert. The PCD cutter insert, thus treated, was then be used as a precursor PCD construction, carefully assembled into a capsule for an ultra-high pressure furnace and subjected to a pressure of about 5.5 GPa and a temperature of about 1,450 degrees centigrade for about 10 minutes and the subjected to a pressure of about 6.0 GPa and a temperature of about 1450 degrees centigrade for between about 8 minutes. The PCD construction thus formed comprised a PCD structure with enhanced diamond grain contiguity, still bonded to the substrate, and cobalt binder infiltrated from the region of the substrate from which binder had not been removed into the region from which it had been removed, as well as into at least a region of the PCD structure adjacent the boundary with the substrate.

Image analysis was conducted on the re-sintered cutter and compared with the image analysis results on an unleached PCD cutter which had not been subjected to re-sintering. The average grain size of the PCD in both cutters was 9 microns. The unleached PCD cutter had an average diamond contiguity of 64% and the leached and re-sintered PCD had a diamond contiguity of 69%. This increase in contiguity may give rise to increased wear resistance performance of the leached and re-sintered cutter compared with equivalent sintered materials (unleached) in vertical borer rock drilling applications testing.

Example 4

A PCD insert was manufactured by sintering diamond grains together on the substrate at an ultra-high pressure of about 5.5 GPa and a temperature of about 1,350 degrees centigrade, as is well known in the art. The insert had a generally cylindrical shape with a diameter of about 17.3 mm and the thickness of the PCD layer was around 2 mm with the overall length of the insert being around 12.5 mm. The interface between the PCD structure and the substrate was non-planar, the substrate having a central portion projecting into a complementary recess within the PCD structure. The diamond content of the PCD structure may be about 89 volume %, the diamond grains having a mean size of about 9 microns in terms of equivalent circle diameter.

The PCD cutter insert was placed in a Teflon® fixture and was subjected to acid treatment using hydrochloric acid to remove cobalt from substantially the whole volume of the PCD cutting structure and a region of the substrate adjacent the boundary with the PCD structure. A mask comprising acid resistant epoxy resin was applied to the surface of the portion of the substrate from which cobalt binder removal is to be avoided. The leaching of the substrate was particularly pronounced around the edges of the cutter insert. The leaching rate was found to be faster along the barrel of the cutter insert compared with the top of the PCD resulting in partial leaching of the substrate along the outer diameter of the cutter insert. The PCD cutter insert, thus treated, was then be used as a precursor PCD construction, carefully assembled into a capsule for an ultra-high pressure furnace and subjected to a pressure of about 6 GPa and a temperature of about 1,450 degrees centigrade for about 8 minutes. The PCD construction thus formed comprised a PCD structure with enhanced diamond grain contiguity, still bonded to the substrate, and cobalt binder infiltrated from the region of the substrate from which binder had not been removed into the region from which it had been removed, as well as into at least a region of the PCD structure adjacent the boundary with the substrate.

Image analysis was conducted on the re-sintered cutter and compared with the image analysis results on an unleached PCD cutter which had not been subjected to re-sintering. The average grain size of the PCD in both cutters was 9 microns. The unleached PCD cutter had an average diamond contiguity of 62% and the leached and re-sintered PCD had a diamond contiguity of 70%. This increase in contiguity may give rise to increased wear resistance performance of the leached and re-sintered cutter compared with equivalent sintered materials (unleached) in vertical borer rock drilling applications testing.

Example 5

A PCD insert was manufactured by sintering diamond grains together on the substrate at an ultra-high pressure of about 5.5 GPa and a temperature of about 1,350 degrees centigrade, as is well known in the art. The insert had a generally cylindrical shape with a diameter of about 17.3 mm and the thickness of the PCD layer was around 2 mm with the overall length of the insert being around 12.5 mm. The interface between the PCD structure and the substrate was non-planar, the substrate having a central portion projecting into a complementary recess within the PCD structure. The diamond content of the PCD structure may be about 89 volume %, the diamond grains having a mean size of about 9 microns in terms of equivalent circle diameter.

The PCD cutter insert was placed in a Teflon® fixture and was subjected to acid treatment using hydrochloric acid to remove cobalt from substantially the whole volume of the PCD cutting structure and a region of the substrate adjacent the boundary with the PCD structure. A mask comprising acid resistant epoxy resin was applied to the surface of the portion of the substrate from which cobalt binder removal is to be avoided. The leaching of the substrate was particularly pronounced around the edges of the cutter insert. The leaching rate was found to be faster along the barrel of the cutter insert compared with the top of the PCD. The PCD was leached down to a depth of about 900 microns, with accelerated leaching on the barrel of the PCD resulting in partial leaching of the substrate along the outer diameter of the cutter insert. The PCD cutter insert, thus treated, was then be used as a precursor PCD construction, carefully assembled into a capsule for an ultra-high pressure furnace and subjected to a pressure of about 5.5 GPa and a temperature of about 1,450 degrees centigrade for about 10 minutes and the subjected to a pressure of about 6.0 GPa and a temperature of about 1450 degrees centigrade for between about 8 minutes. The PCD construction thus formed comprised a PCD structure with enhanced diamond grain contiguity, still bonded to the substrate, and cobalt binder infiltrated from the region of the substrate from which binder had not been removed into the region from which it had been removed, as well as into at least a region of the PCD structure adjacent the boundary with the substrate.

Image analysis was conducted on the re-sintered cutter and compared with the image analysis results on an unleached PCD cutter which had not been subjected to re-sintering. The average grain size of the PCD in both cutters was 9 microns. The unleached PCD cutter had an average diamond contiguity of 64% and the leached and re-sintered PCD had a diamond contiguity of 69%. This increase in contiguity may give rise to increased wear resistance performance of the leached and re-sintered cutter compared with equivalent sintered materials (unleached) in vertical borer rock drilling applications testing.

Some embodiments may provide PCD constructions having enhanced thermal stability or enhanced erosion resistance, or both enhanced thermal stability and enhanced erosion resistance.

In some embodiments, maintaining alignment of the PCD structure and the substrate even after the further pressure treatment is possible.

In some embodiments, the movement of binder material in the substrate towards or into the diamondiferous structure may be controlled or limited during the further pressure treatment.

In some embodiments, the cemented carbide substrate has sufficient strength after the first pressure treatment for it to be capable of being handled even after subsequent treatment to remove binder material in preparation for the further pressure treatment.

In some embodiments, it is possible that there is a reduced cost in producing PCD constructions having enhanced strength. This may be achieved because it may be possible to have improved control through the method, and it has reduced number of process steps so the direct costs may be reduced due to this or a combination of these or other factors.

Some embodiments may result in PCD constructions having substantially enhanced thermal stability and enhanced fracture resistance, which may arise at least partly from a non-planar interface configured to reduce internal stresses. In some embodiments it is possible to produce PCD constructions having complex shapes.

Although the foregoing description of PCD constructions, tools, manufacturing methods and various applications contain many specifics, these should not be construed as limiting, but merely as providing illustrations of some examples of embodiments.

The invention claimed is:

1. A method for making a polycrystalline diamond (PCD) construction, the method including placing an aggregate mass of diamond grains onto a cemented carbide substrate comprising carbide grains cemented together by a cement material;

subjecting the aggregate mass and the substrate to a first pressure treatment to form a sintered construction comprising a diamondiferous structure joined to the substrate at a boundary during the first pressure treatment, wherein the diamondiferous structure comprises a PCD structure;

treating the construction to remove at least some of the cement material from at least a region of the substrate adjacent the boundary; and subjecting the substrate to a second pressure treatment.

2. A method as claimed in claim 1, wherein the first pressure treatment is carried out at a pressure of at least about 1 GPa and a temperature of at least about 1,000 degrees centigrade.

3. A method as claimed in claim 1, wherein the boundary defined by the substrate is substantially non-planar.

4. A method as claimed in claim 1, further comprising integrally forming the diamondiferous structure with the substrate during the first pressure treatment.

5. A method as claimed in claim 1, further comprising placing the substrate adjacent a support body to form a precursor assembly; and subjecting the precursor assembly to the second pressure treatment to join the support body to the substrate attached to the diamondiferous structure.

6. A method as claimed in claim 1, further comprising treating the diamondiferous structure to remove at least some of metal catalyst for diamond from at least a region therein.

7. A method as claimed in claim 1, wherein the second pressure treatment comprises subjecting the substrate and the diamondiferous structure to a pressure of at least about 5.5 GPa and a temperature of at least about 1,200 degrees centigrade.

8. A PCD construction made using the method as claimed in claim 1.

* * * * *